US010099915B2

(12) United States Patent
Kittoe

(10) Patent No.: US 10,099,915 B2
(45) Date of Patent: Oct. 16, 2018

(54) MULTIPLE NON-MANIFOLDED FUEL TANKS ON A PORTABLE PLATFORM

(71) Applicant: Robinson Metal, Inc., De Pere, WI (US)

(72) Inventor: Keith Kittoe, Greenbay, WI (US)

(73) Assignee: Robinson Metal, Inc., DePere, WI (US)

( * ) Notice: Subject to any disclaimer, the term of this patent is extended or adjusted under 35 U.S.C. 154(b) by 0 days.

(21) Appl. No.: 15/179,945

(22) Filed: Jun. 10, 2016

(65) Prior Publication Data

US 2017/0313570 A1 Nov. 2, 2017

Related U.S. Application Data

(60) Provisional application No. 62/329,746, filed on Apr. 29, 2016.

(51) Int. Cl.

| | |
|---|---|
| ***B67D 1/00*** | (2006.01) |
| ***B67D 7/14*** | (2010.01) |
| ***B67D 7/70*** | (2010.01) |
| ***B67D 7/78*** | (2010.01) |
| ***B67D 7/84*** | (2010.01) |
| ***B67D 7/04*** | (2010.01) |
| ***B67D 7/36*** | (2010.01) |
| ***B67D 7/62*** | (2010.01) |

(52) U.S. Cl.

CPC ..... *B67D 7/04* (2013.01); *B67D 7/36* (2013.01); *B67D 7/62* (2013.01); *B67D 7/78* (2013.01); *B67D 7/845* (2013.01)

(58) Field of Classification Search

CPC ..... B67D 7/04; B67D 7/36; B67D 7/62

USPC ..... 222/52, 109, 129, 132, 135, 143, 145.1, 222/145.2, 318, 424

See application file for complete search history.

(56) References Cited

U.S. PATENT DOCUMENTS

| | | | | | |
|---|---|---|---|---|---|
| 2,146,729 | A * | 2/1939 | Gavin | B64D 37/20 | 137/111 |
| 2,421,765 | A * | 6/1947 | Taylor | B60P 3/243 | 137/208 |
| 2,498,229 | A * | 2/1950 | Adler | B60P 3/14 | 119/DIG. 1 |
| 3,253,746 | A * | 5/1966 | Vreedenburgh | B63B 25/10 | 114/74 R |
| 4,911,330 | A * | 3/1990 | Vlaanderen | B60P 3/224 | 222/132 |
| 5,018,645 | A * | 5/1991 | Zinsmeyer | B67D 7/425 | 222/132 |
| 6,131,768 | A * | 10/2000 | Taivalkoski | B67D 7/04 | 222/14 |
| 6,915,815 | B1 * | 7/2005 | Ness | E21B 21/01 | 137/255 |
| 7,484,521 | B2 * | 2/2009 | Kimbara | F17C 13/025 | 137/14 |
| 2009/0200333 | A1 * | 8/2009 | Bauer | B60P 3/14 | 222/1 |

(Continued)

*Primary Examiner* — Vishal Pancholi

(74) *Attorney, Agent, or Firm* — Andrus Intellectual Property Law, LLP

(57) ABSTRACT

A system of multiple non-manifolded fuel tanks on a portable platform and preferred embodiments which allow for improved access to the contents of each fuel tank, ability to transport multiple fuel types in a single system on a vehicle without towing apparatus, and the ability to maneuver the system via a forklift.

27 Claims, 9 Drawing Sheets

(56) References Cited

U.S. PATENT DOCUMENTS

| | | | | |
|---|---|---|---|---|
| 2011/0048572 | A1* | 3/2011 | Batson | B64F 1/28 141/1 |
| 2014/0263350 | A1* | 9/2014 | Sheppard | B65D 88/54 220/500 |

* cited by examiner

MULTIPLE NON-MANIFOLDED FUEL TANKS ON A PORTABLE PLATFORM

FIELD OF THE INVENTION

The present invention relates to a system of multiple non-manifolded fuel tanks on a portable platform for portable fueling, storage, and dispensing.

BACKGROUND

In the present art area of portable fuel storage and dispensing system offerings, models, and options, the same types and styles have remained largely unchanged leaving demand for an intermediate size solution that offers versatility while complying with federal regulations unfulfilled. Presently, if a consumer for personal use, business for commercial use, or government and military buyer for their uses needs a portable fueling storage and dispensing system, their options are limited to small five gallon style jugs and cans, auxiliary tanks permanently installed into the bed of pickup trucks, multi-tank skid systems with limited ease of use and functionality, or multi-hundred gallon to 1,000 gallon capacity single tank trailers predominantly found and used in the agriculture industry. The lack of portable fueling solutions available in between the small container sizes up to the larger 1,000 gallon sizes represents a significant gap in the present prior art.

If one needs to transport fuel in a storage tank or tank trailer for use in commerce, operators transporting Class 3 Flammable Fuels such as gasoline or diesel, are required by United States Department of Transportation (DOT) to have a commercial driver's license and hazmat rating endorsement if the single tank being used has a capacity that exceeds 119 gallons. These larger tanks are classified as bulk containers or cargo tanks, depending on their size and exact use. Typically, the truck, trailer, or other motor vehicle being used to transport these larger tanks also has to meet the requirements of certain federal safety standards and additional regulations. DOT 406 and similar variations of the 406 indication are the most commonly known cargo tank regulations and specification requirements in the petroleum equipment and fuel transport industry regarding the types of tanks used to transport flammable liquids such as gasoline.

In most states, gasoline and similar types of fuels are not to be transported for use in commerce in containers larger than five-gallon capacity sizes, or other similar small capacity sizes. Whereas, if a fuel tank container or fuel tank motor vehicle is purchased from a manufacturer with DOT authorization, operators are exempt from needing a DOT 406 tank or cargo tank vehicle when transporting fuel tanks on a platform with single tank capacities under 450 liters/119 gallons.

An example of the prior art in the market can be found at: http://www.qualityfueltrailers.com/transfer-m-series-modular-fuel-tank-skids This prior art example has many features, specifications, and characteristics that make it obviously and significantly different than the present invention when examined by operators and other individuals familiar with fuel transport equipment and hazardous material requirements. The prior art does not include a rear enclosure to house the fueling equipment and protect the fueling equipment from any outside elements. The fueling equipment available in the prior art is limited to a basic pump and hose whereas the present invention's preferred embodiment offers many electronic accessories to ease fueling and fuel transaction record keeping processes. The prior art features a difficult to operate method of connecting the pump suction line to the top of each tank whereas the present invention features easy to access tank selection coupling and adapters within the rear enclosure. The present invention also features additional security measures including but not limited to: metal guards on tank gauges, lockable fill caps, and lockable rear enclosure.

Common in the prior art are the use of a forklift maneuverable pallet, the use of a fuel pump, the common style of a fuel dispensing hose reel, hose, and nozzle, as well as the grounding cable reel which prevents static spark discharge between the skid and vehicle or equipment being fueled. Also common in the prior art is the use of a filtration system which can remove particulates, debris, water, and other unwanted elements in the fuel, tank, or other areas before fuel is discharged into the vehicle or equipment being fueled. Different types of filters are commonly available and known to remove different elements.

SUMMARY OF THE INVENTION

The tanks and containers detailed in the present invention are built to the specifications outlined by a DOT Special Permit. By doing so, the present invention is compliant for use in commerce with Class 3 Flammable Liquids, specifically gasoline, aviation gasoline, methanol, ethanol, jet turbine fuels, and other flammable liquids with a flash point below 100 degrees Fahrenheit. In addition, even though they are not typically classified as Class 3 Flammable Liquids on their own, the Special Permit also permits the legal transportation of diesel, kerosene, and fuel oils that are considered combustible liquids by the DOT when being transported on roads and highways due to their flash point being above 100 degrees Fahrenheit.

To gain additional volume capacity, multiple tanks are adhered to the platform yet kept completely independent of each other. Keeping the tanks entirely independent from each other maintains compliance with the DOT Special Permit by preventing fuel from one tank coming into contact with fuel from another tank during transportation. If the tanks were connected by any means or manifolded together, such as by fuel lines, hoses, valves, fittings, or other flow channels, the tanks would be considered one single container and therefore non-compliant for use in commerce when transporting Class 3 Flammable Liquids on roads and highways. This fact makes the tank selector mechanisms integral to the present invention. The tank selector mechanisms allow for any tank on the platform to have fuel dispensed from it, but from only one tank at a time with single tank selector mechanisms. With multi-tank selector mechanisms, more than one tank can be connected together to act and function as a single larger tank, but then quickly separated prior to transportation. A preferred embodiment of the present invention includes the use of dry break, no-spill, quick connect couplers and adapters to allow a user to have rapid and easy switching between tanks for dispensing fuel.

The fuel is dispensed from the fuel tanks through the fueling system which is hidden from plain-view within the rear enclosure. Not only does the enclosure hide the most expensive components to the system, but it also protects them from external weather elements or damage. Each tank has independent bottom sump port openings that provide the fitting and connection point for the fuel lines and hoses to channel the fuel from each tank to the rear enclosure. The quick connect adapters are affixed onto the fuel lines and hoses that enter the rear enclosure to create the selector adapter points for each tank. The quick connect coupler on the fuel pump intake hose line is what pairs with and connects to an adapter on any of the tank fuel lines to create a dry break, non-spill connection point.

Besides the tanks and enclosure, a preferred embodiment of the present invention features an electric powered fuel dispensing and metering system. The system suctions fuel from the tanks, filters it, measures it, and dispenses it into vehicles or equipment up to 100 feet away.

The present invention is a portable multiple non-manifolded fuel tank skid for use in commerce or private use with each tank having a capacity of under 119 gallons that has a primary purpose of transporting and discharging flammable and combustible liquids. Examples of commonly transported flammable and combustible liquids include but are not limited to gasoline, motor gasoline, MoGas, diesel, kerosene, aviation gasoline (AvGas or AV gasoline), 100 low lead (100LL), jet turbine fuel (Jet A or JP8), ethanol, ethyl alcohol, or methanol.

The present invention allows for different types and different grades of fuel to be transported and discharged from a single portable platform. Various discharge methods and configurations are possible while remaining cross-contamination free from different fuel types. Possible solutions are using a single pump to draw fuel from one tank at a time when all tanks have the same fuel type in them, or using multiple pumps concurrently from separate tanks with the same fuel type or fuel grade, or using multiple pumps concurrently with different fuel types drawn from different tanks.

The transportation of Class 3 Flammable Liquids in commerce makes them a federally regulated hazardous material under most circumstances and conditions. As a result, single container tanks that exceed certain size and type classifications can lead to increased costs, requirements, training, and other factors for both the operators and companies involved in the transportation process. For example, DOT 406 specification tank costs for single containers over 119 gallons in capacity used to transport gasoline are significantly more expensive to manufacture and produce due to the American Society of Mechanical Engineers material and welding requirements. The present invention utilizes multiple smaller tank containers that are each under 119 gallons or 450 liters in capacity to still achieve the total capacity needed on a single trailer or vehicle platform. The present invention can significantly reduce total costs. The present invention is able to achieve this significant cost savings by following manufacturing requirements and design specifications that are different than those of standard DOT 406 cargo tanks and cargo tank vehicles while still meeting DOT safety requirements outlined within the Special Permit. The present invention allows for the ability to transport multiple non-manifolded fuel tanks on a portable platform as a single system which allows the user to fill each tank with a different liquid or to fill each tank with the same liquid, while allowing the user to maintain the independence of each tank, which allows the invention to maintain compliance with federal regulations and safety concerns.

The present invention is a portable platform system that can be mounted in the bed of a pickup or flatbed truck and in a preferred embodiment, via a forklift. It is then secured to the tow vehicle via mounting brackets and hardware. The preferred embodiment of the present invention functions when one or all of the tanks contain fuel and power is switched on for the electronic components to operate. The electronic components primarily consist of the pump, meter, valves, register, metering equipment, and transaction reporting mechanisms. A preferred embodiment has electronic controls and components, but alternatively, the pump and meter can be mechanically controlled which is known in the art. Fuel is to be drawn from, or discharged into, the tank hose lines that become attached to the pump when the tank selector coupling on the pump intake hose line is quick connected to any of the tank selector dry break adapters of a corresponding tank. Before placing the nozzle into the external vehicle for fueling, the grounding cable is attached to a metal contact point on the external vehicle. Once the flow through the opening of the nozzle is engaged, fuel is suctioned from the tank via the pump. After leaving the pump, fuel is pushed to the filter where it is cleaned of particulate debris, water, or other contaminates before flowing into the air eliminator for the separation of any air that may be present in the fuel lines. Air separated by the air eliminator is exhausted to an overflow tank to capture any liquid droplets in a container that escape through the air vapor exhaust. All the fuel that passes through the air eliminator enters the metering chamber of the flow meter. This is where the precise volume of fuel being dispensed is calculated. After the fuel exits the meter, it moves into the hose that may be coiled around a hose reel and then through the nozzle and into a vehicle or equipment. The fuel volume data is read via the meter register. Meter and transaction data is locally stored on the fueling station's transaction and monitoring computer system that can be archived at a later time or uploaded and transmitted in real time through cellular, WiFi, Bluetooth, radio, or other wired or wireless data communication method. After fuel is depleted from first tank, the tank selector coupling on the pump intake fuel line can be moved to a second tank for further fueling or placed back onto the tank selector holder. If placed in the tank selector holder, the operator would then typically retract the fuel dispensing hose and nozzle, releases the grounding clamp, turns off the power to the electronic components, and become ready to relocate the portable fueling system.

The present invention features multiple non-manifolded tanks on a single portable platform to allow for additional volume capacity while maintaining compliance with the Department of Transportation's regulatory guidelines. Each non-manifolded tank has three integral accessories adhered to the top. The first is the fill cap. Its function is to provide access to a tank for filling with fuel. In a preferred embodiment, the fill cap includes a key and lock mechanism to prevent unwanted personnel from accessing tank contents. The fill cap also provides venting for the tank to 'breathe' as tank pressure can vary with external and internal temperature changes. The second tank accessory is the fuel level gauge. The fuel level gauge's function is to display the amount of fuel in each tank. The fuel level gauge incorporates a metal guard to protect it from any damage. The third accessory is the pressure vent and rollover valve. This item serves two functions: it is a secondary vent that allows air to pass in or out of the tank as external temperature and pressures change and it has an internal mechanism that closes itself to prevent a leak point in event of a rollover of the transport vehicle.

The tank selection valves, adapters, and couplers allow for the tanks to maintain independence from one another while also allowing fuel from any tank to be suctioned and dispensed via a single pump. With the tanks being suctioned and dispensed from a single pump, cost savings are achieved as multiple pumps, meters, and hose reels become prohibitive to the market. Besides cost savings, the present invention's single dispensing system also allows for a more compact and smaller footprint.

In a preferred embodiment, the filter cleans the fuel of particulates that may have come from the tank or the original fuel source. A filter that not only removes particulates, but detects water—which can be detrimental to fuel—is also available and known in the art. In one embodiment, the present invention's custody transfer meter provides means to accurately measure fuel volume. This type of meter is required by state agencies to operate a system where fuel is sold from one entity to another. The air eliminator removes air from the fuel to provide the most accurate fuel measurement possible.

The preferred embodiment includes the meter register with touch screen display or keypad and monitor display along with an Electronic Transaction Reporting Computer System. The meter display reads and translates meter data in usable information for the operator. The Electronic Transaction Reporting Computer System then takes that data and uploads to a remote computer with internet access so the data can be further interpreted and stored for operator record keeping.

The fuel hose on hose reel and nozzle are the means in which the fuel is dispensed into a customer or third party's vehicle. The fuel hose reel keeps a long hose needed for additional range in a confined and neat space. The nozzle controls the flow of fuel throughout the system's entirety. Opening the nozzle distributes the fuel into the third party vehicle. Closing the nozzle disengages flow. Multiple features and potential configurations of the fuel hose are known in the art.

In the preferred embodiment, the tanks and fueling system inside the rear enclosure are affixed to the top of a forklift maneuverable skid platform. In the preferred embodiment, the present invention is forklift maneuverable to allow for the ability to rapidly mount, remove, and replace a given system with another unit, perhaps replacing an empty system with a full one, or one with different fuel types to be rotated onto the same transport vehicle. The preferred embodiment of the present invention incorporates all of the disclosed components into a single portable platform. The preferred embodiment of the forklift maneuverable version of the present invention allows it to be easily transferred between transport vehicles and secured to each transport vehicle via a means of mounting brackets. There are multiple means for securing the portable platform to a vehicle know to the art.

DETAILED DESCRIPTION OF THE PREFERRED EMBODIMENTS

Figure 1:
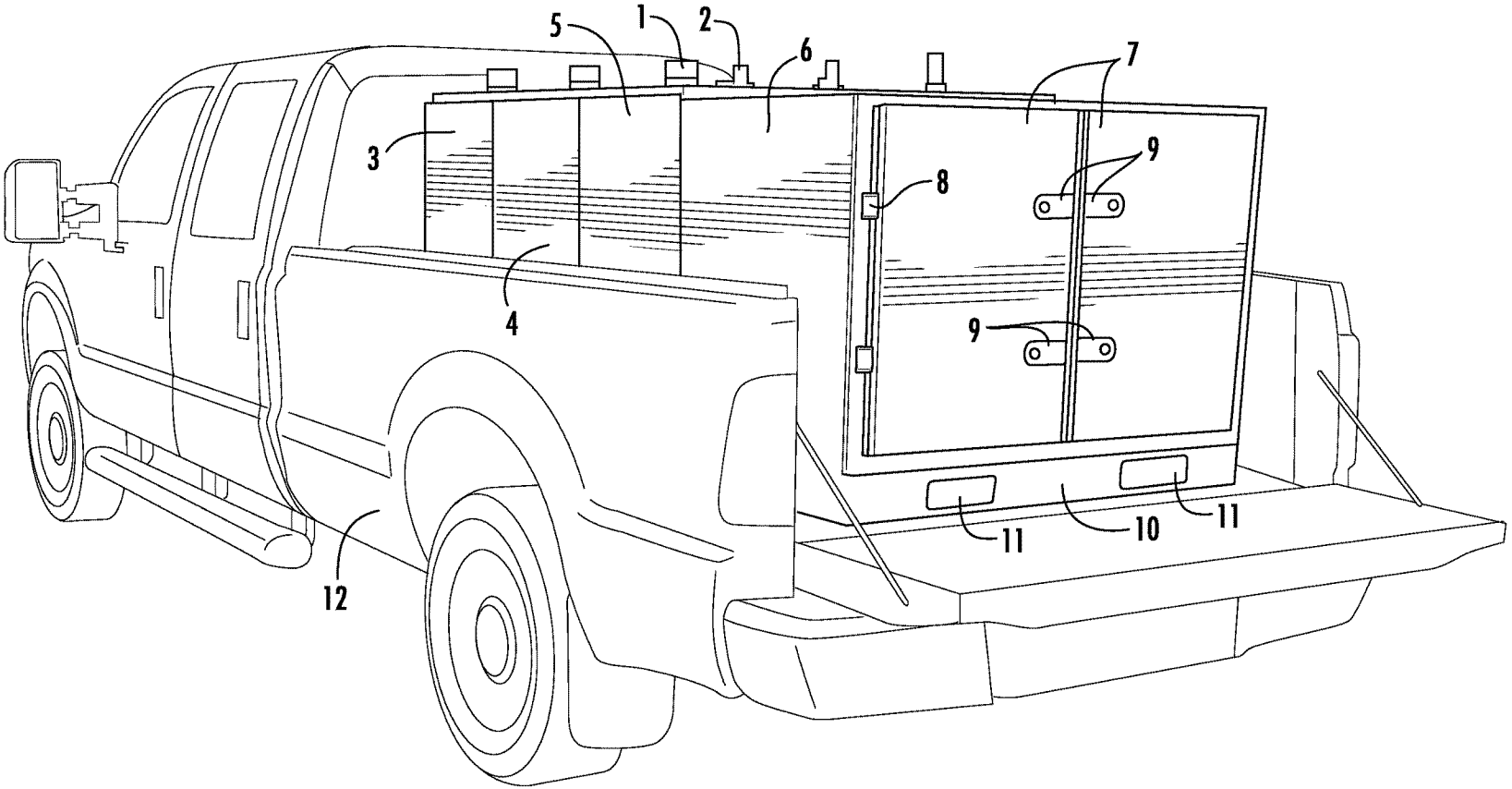
FIG. 1 is a perspective view showing the present invention in the bed of a transport vehicle.

FIG. 1 shows a perspective view of an embodiment of the present invention in an assembled state. The embodiment of the present invention has multiple non-manifolded fuel tanks 3, 4, and 5. Each tank 3, 4, and 5 has an independent fuel level gauge 2, pressure vent and rollover valve—not visible from the perspective of FIG. 1—and a lockable fill cap 1. In a preferred embodiment the rear enclosure 6 includes enclosure swing doors 7 connected to the rear enclosure with hinges 8 and inclusive of handles with door locks 9. The fuel station base platform 10 includes forklift pockets 11 and is the foundation for the tanks 3, 4, 5 and rear enclosure 6. In the preferred embodiment, the present invention is placed in and secured to a transport vehicle 12 for mobility.

Figure 2:
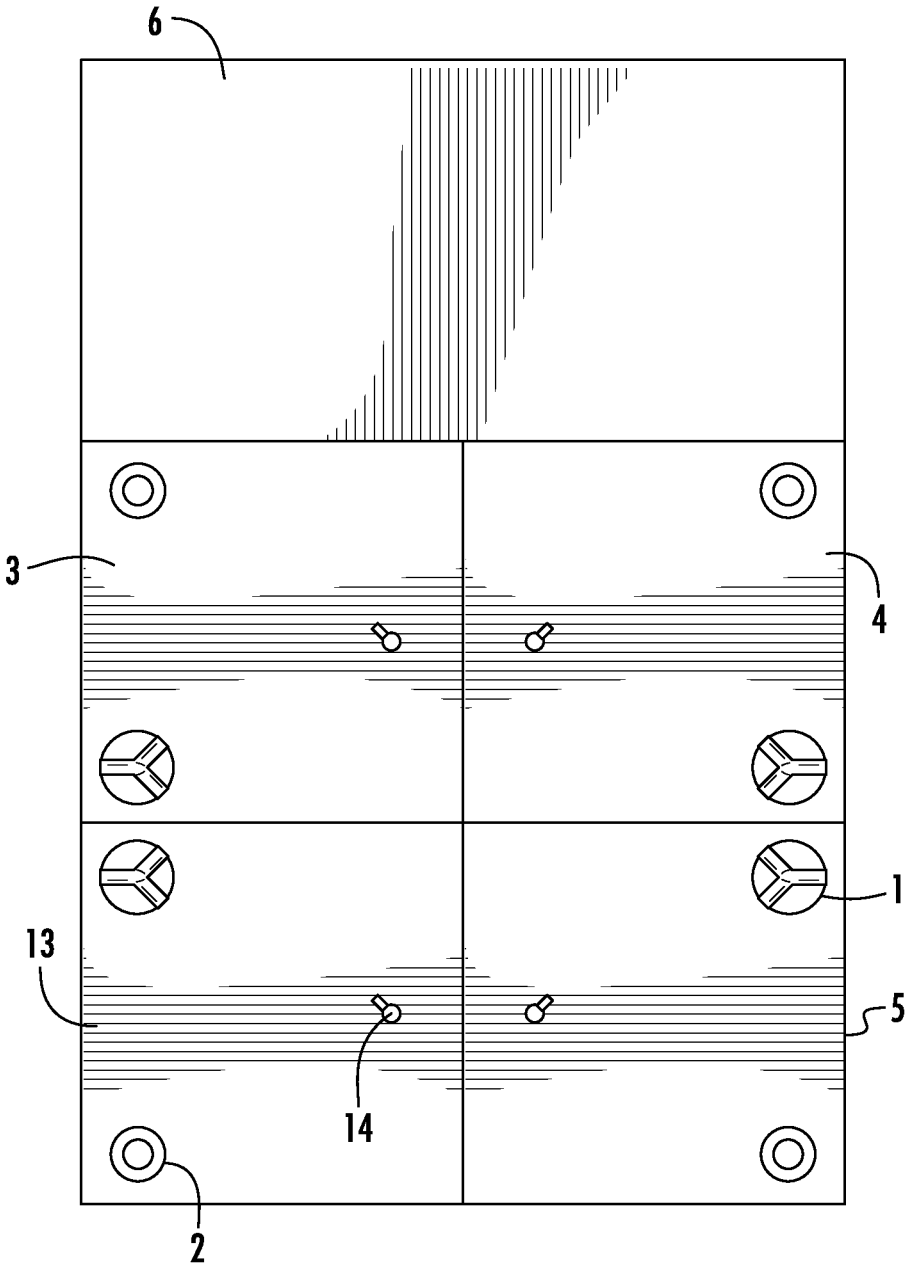
FIG. 2 is a top down view which depicts an embodiment of the present invention with four tanks in a parallel orientation.

FIG. 2 is a top down view which depicts an embodiment of the present invention with four non-manifolded tanks 3, 4, 5, 13 in a parallel orientation also described as two by two, a potential configuration of the tanks. Each tank 3, 4, 5, 13 has a fuel level gauge 2, a pressure vent and rollover valve 14, and lockable fill cap 1. In a preferred embodiment the lockable fill cap 1 of the non-manifolded fuel tanks 3, 4, 5, 13 would be placed towards the outer most edge of the tank and towards any shared edges with other fuel tanks to allow for ease of access while filling the tanks. It is understood that while the present depiction shows four non-manifolded fuel tanks, the present invention allows for the expansion or contraction of the portable platform size to incorporate additional or fewer non-manifolded fuel tanks as desired. The rear enclosure 6 encompasses and allows access to components not visible in FIG. 2 from the rear of the present invention.

Figure 3:
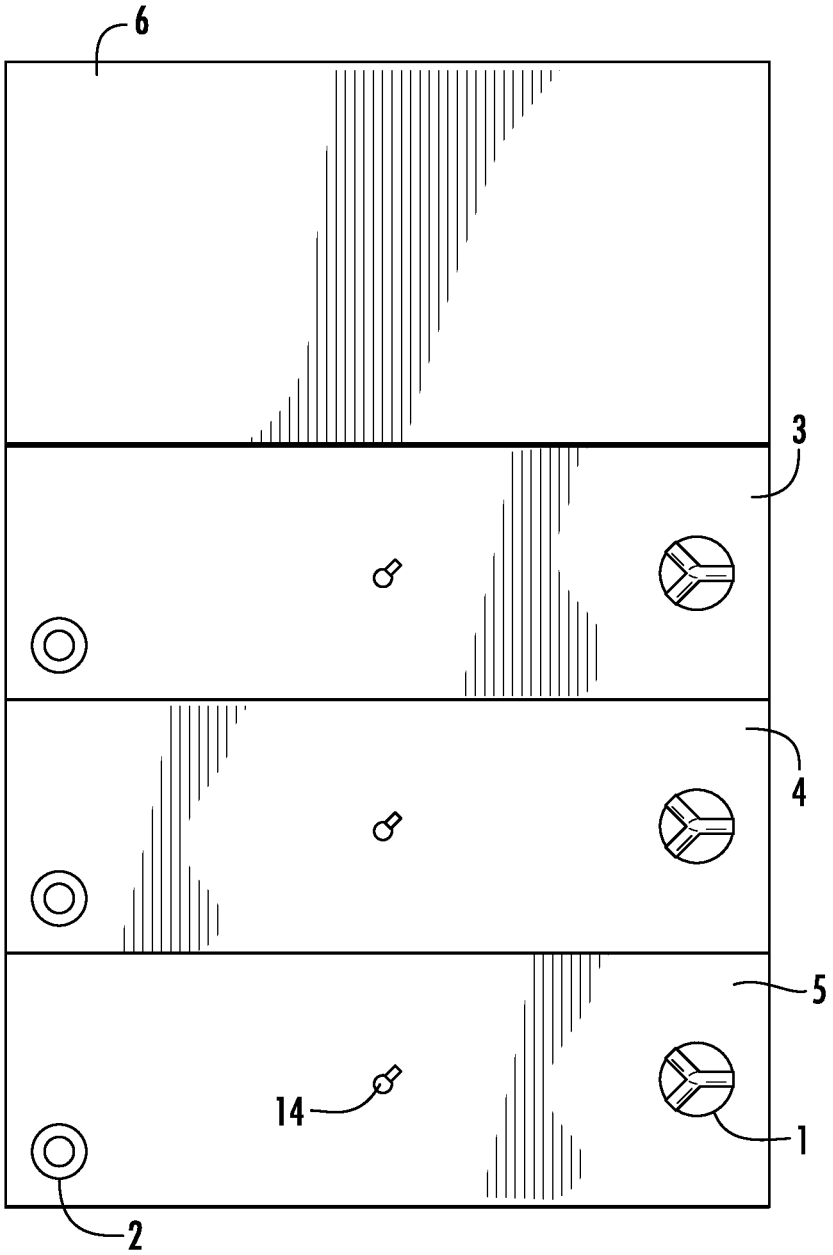
FIG. 3 is a top down view which depicts another embodiment of the present invention with three tanks in a linear orientation.

FIG. 3 is a top down view which depicts another embodiment of the present invention with three non-manifolded tanks 3, 4, 5 in a linear orientation and another potential configuration of the tanks. Each tank 3, 4, 5 has a fuel level gauge 2, pressure vent and roll over valve 14, and lockable fill cap 1. In a preferred embodiment the lockable fill cap 1 of the non-manifolded fuel tanks 3, 4, 5 would be placed towards the outer most edge of the tank to allow for ease of access while filling the tanks. It is understood that while the present depiction shows three non-manifolded fuel tanks, the present invention allows for the expansion or contraction of the skid size to incorporate additional or fewer non-manifolded fuel tanks as desired.

Figure 4:
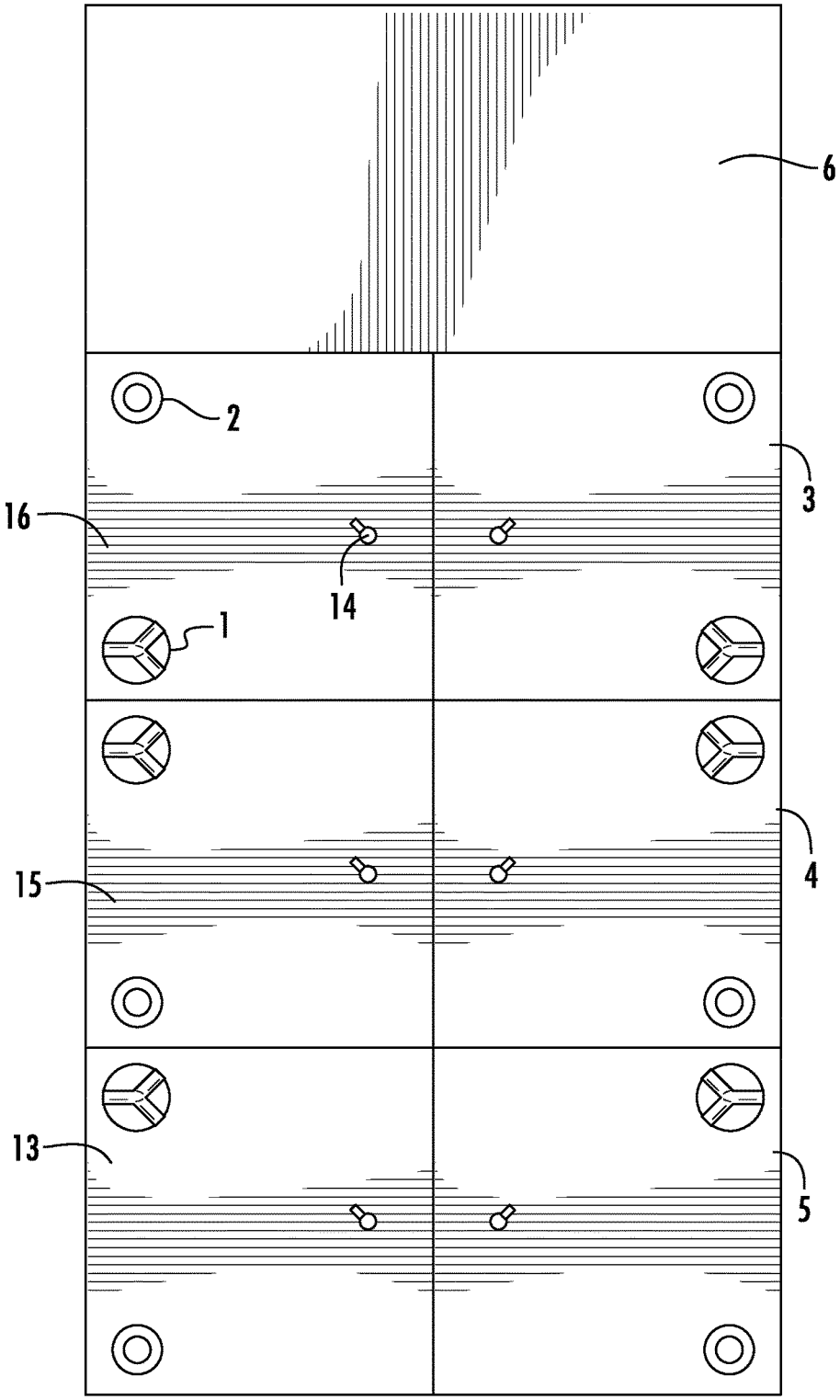
FIG. 4 is a top down view which depicts another embodiment of the present invention with six tanks in a parallel orientation.

FIG. 4 is a top down view which depicts another embodiment of the present invention with six non-manifolded tanks 3, 4, 5, 13, 15, 16 in a parallel orientation also described as two by three, another potential configuration of the tanks. Each tank 3, 4, 5, 13, 15, 16 has a fuel level gauge 2, pressure vent and roll over valve 14, and lockable fill cap 1. In a preferred embodiment the lockable fill cap 1 of the non-manifolded fuel tanks 3, 4, 5, 13, 15, 16 would be placed towards the outer most edge of the tank to allow for ease of access while filling the tanks. It is understood that while the present depiction shows six non-manifolded fuel tanks, the present invention allows for the expansion or contraction of the skid size to incorporate additional or fewer non-manifolded fuel tanks as desired.

Figure 5:
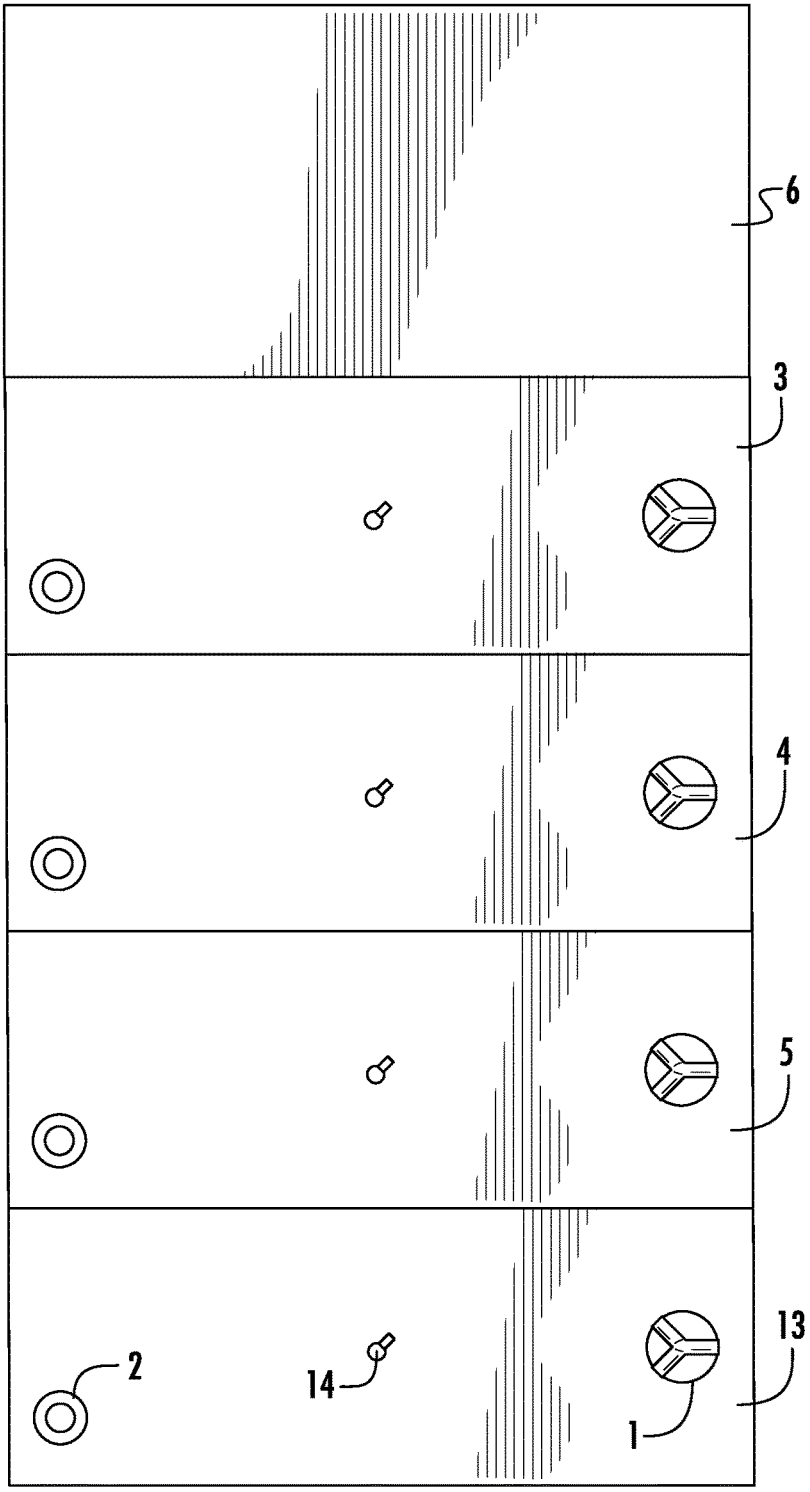
FIG. 5 is a top down view which depicts an embodiment of the present invention with four tanks in a linear orientation.

FIG. 5 is a top down view which depicts another embodiment of the present invention with four non-manifolded tanks 3, 4, 5, 13 in a linear orientation and another potential configuration of the tanks. Each tank 3, 4, 5, 13 has a fuel level gauge 2, pressure vent and roll over valve 14, and lockable fill cap 1. In a preferred embodiment the lockable fill cap 1 of the non-manifolded fuel tanks 3, 4, 5, 13 would be placed towards the outer most edge of the tank to allow for ease of access while filling the tanks. It is understood that while the present depiction shows four non-manifolded fuel tanks, the present invention allows for the expansion or contraction of the skid size to incorporate additional or fewer non-manifolded fuel tanks as desired.

Figure 6:
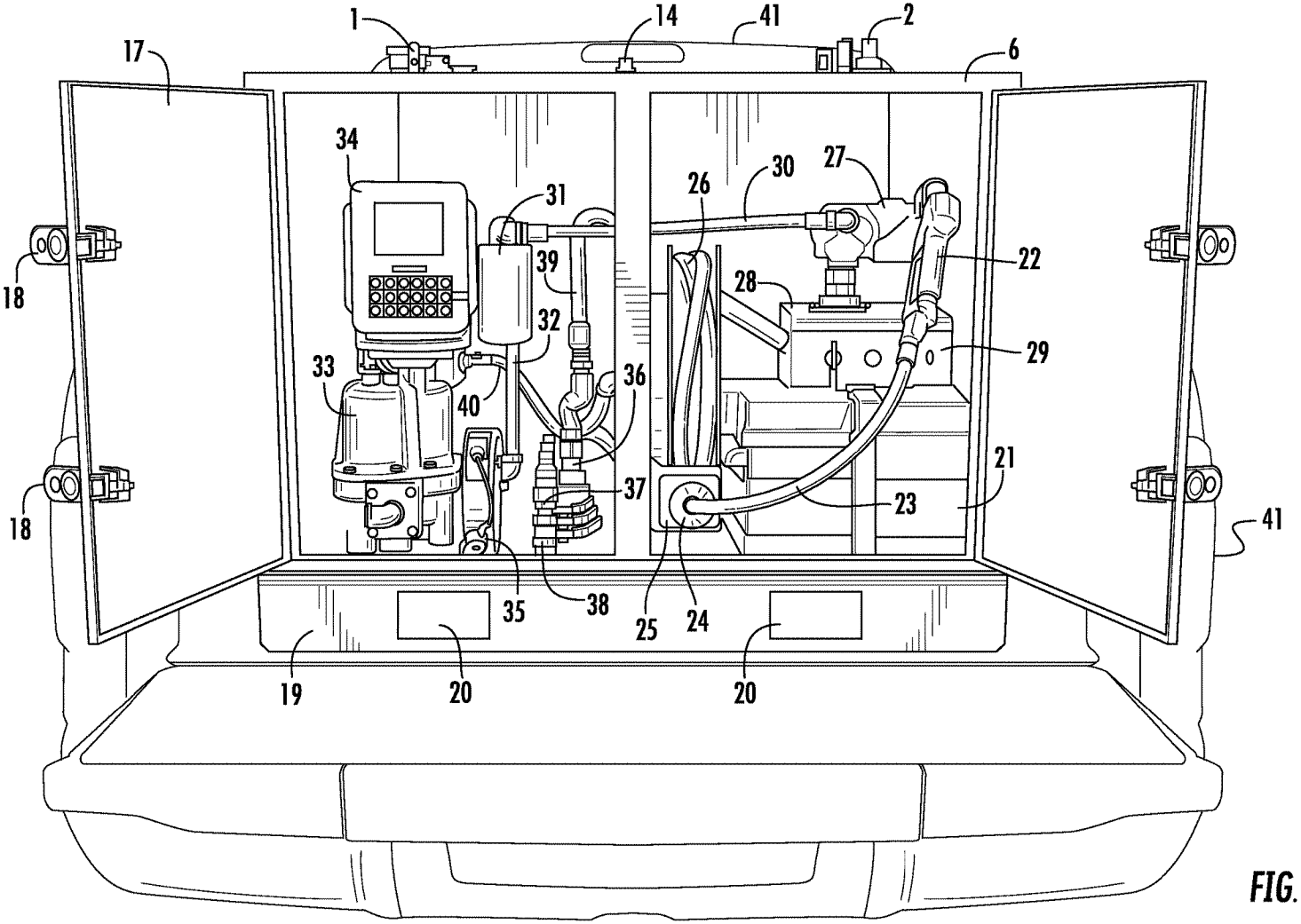
FIG. 6 is a rear view showing an embodiment of the present invention with a dual door access configuration.

FIG. 6 is a rear view showing an embodiment of the present invention with a dual enclosure swing door 17 access configuration to the rear enclosure 6. Each door includes handles and door locks 18. From this perspective of the present invention, the non-manifolded tanks are not visible, but the lockable fill cap 1, pressure vent and roll over valve 14, and fuel level gauge 2 connected to the top of each tank are visible. In a preferred embodiment of the present invention, the components inside the rear enclosure 6 start with the tank selector coupling 36 connecting to the tank selector adapter 37. The tank selector shutoff valve 38 is opened to allow fuel up the fuel hose 39 to the fuel pump 27. The fuel pump 27 sits atop a mounting bracket 28 and is powered by the battery box enclosure 21. Electricity to the fuel pump 27 is controlled by a power switch 29. The fuel pump 27 then pushes fuel through fuel hose 30 to the filter 31 and into another fuel hose 32 to meter 33. Meter data and information is input and read through a meter register 34. After the meter 33, the flow continues through fuel hose 40 to hose reel 26 and out through a nozzle 22. The hose reel 26 may consist of a hose reel guide 25 and hose ball stop 24 to direct and control fuel hose 23. A grounding reel 35 connects to fuel recipient and maintains static ground between the two parties. The present invention is held together by the portable platform 19 and in a preferred embodiment may be loaded into the transport vehicle 41 by forklift through forklift pockets 20.

Figure 7:
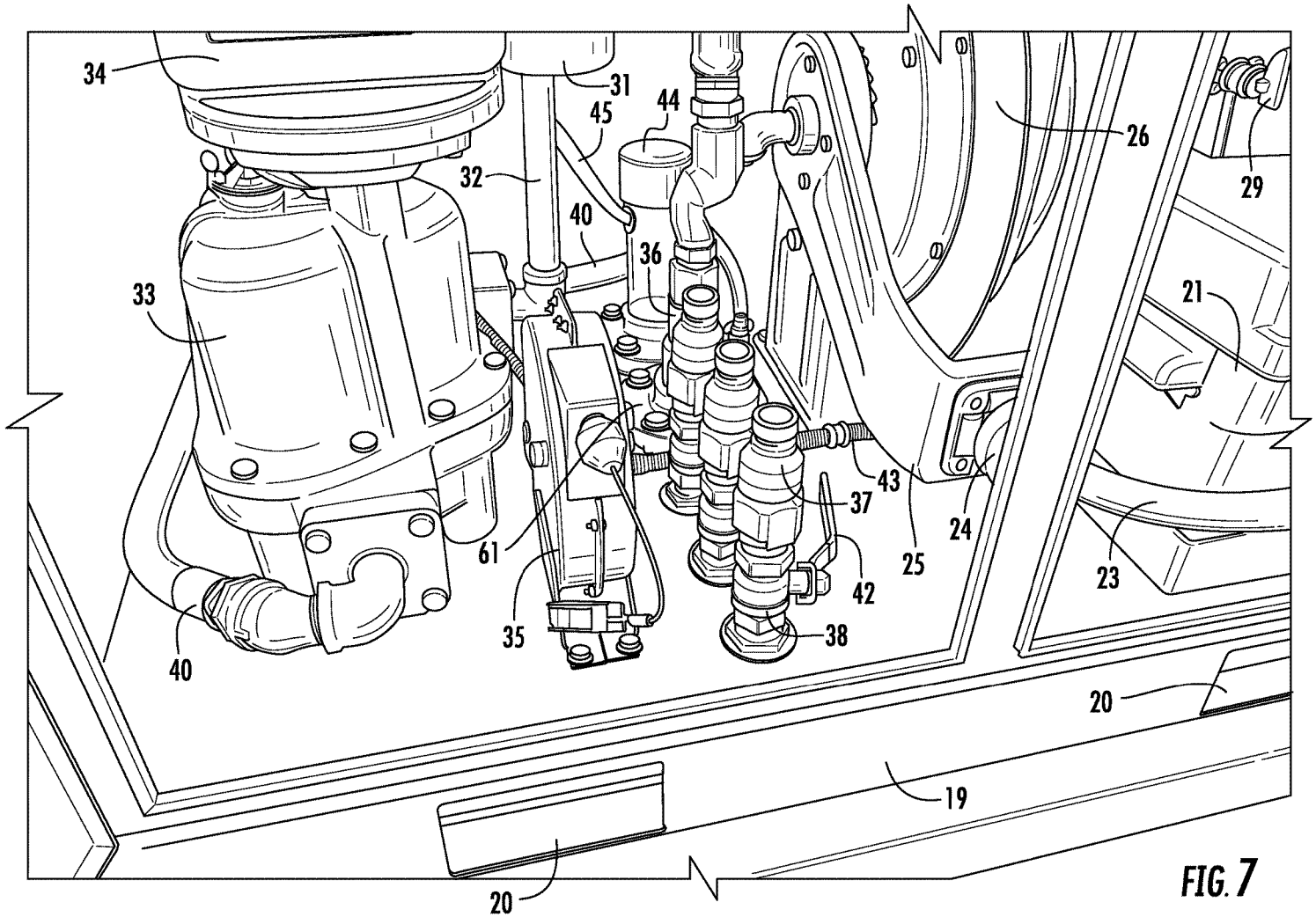
FIG. 7 is an exploded perspective view showing an embodiment of the internal components of the rear enclosure for a three tank linear orientation.

FIG. 7 is an exploded perspective view showing an embodiment of the internal components of the rear enclosure for a three tank linear orientation. The power switch 29 controls system electricity supplied from the battery in the battery box enclosure 21. Electricity travels to the meter 33 and meter register 34 via the electrical line cable 43. The grounding cable reel 35 maintains electrical balance with the fuel recipient vehicle when connected during fueling. A preferred embodiment of the tank selector shutoff valve 38 includes a shutoff handle 42. The tank selector adapter 37 is mounted above its corresponding tank selector shutoff valve 38. The tank selector coupling 36 is held inside of the mounting bracket holder 61 as this figure shows the system while in storage/transport mode. While fuel is being discharged from the pump, fuel is cleaned of particulates or contaminants in the filter 31 and travels to the meter 33 via a fuel hose 32. The air eliminator that is attached to the meter intake directs air from the fuel through the air eliminator transfer line 45 to the air eliminator exhaust catch tank 44 where the air is dispelled. Fuel from the meter 33 then travels out the fuel hose 40 to the hose reel 26. The dispensing fuel hose 23 is directed outward by the hose reel guide 25 and the hose ball stop 24. The forklift pockets 20 of the fuel station base platform 19 can be seen at the bottom of the figure.

Figure 8:
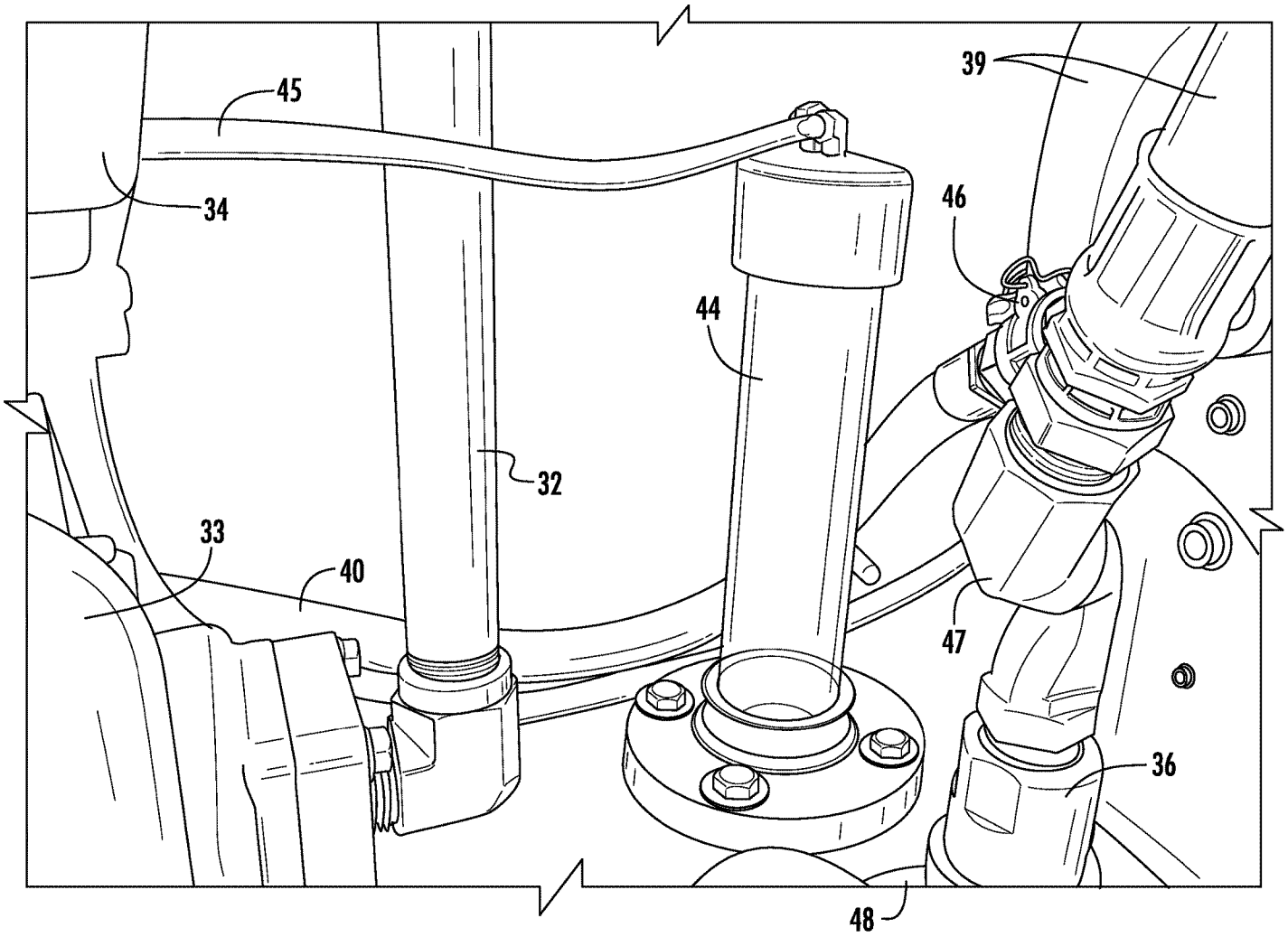
FIG. 8 is an exploded perspective view showing an embodiment of the air eliminator component.

FIG. 8 is an exploded perspective view showing an embodiment of the air eliminator component. The air eliminator exhaust catch tank 44 is connected to the meter 33 via the air eliminator transfer line 45. Fuel enters the meter 33 from the fuel hose 32 and fuel volume data is read on the meter register 34. The fuel hose 40 connects the meter 33 to the hose reel by means of a quick connect hose detachment 46. In front of the hose reel is the tank selector coupling 36 attached to the tank selector coupling bracket holder mount 48. The tank selector coupling is also connected to a swivel fitting 47 and fuel hose 39.

Figure 9:
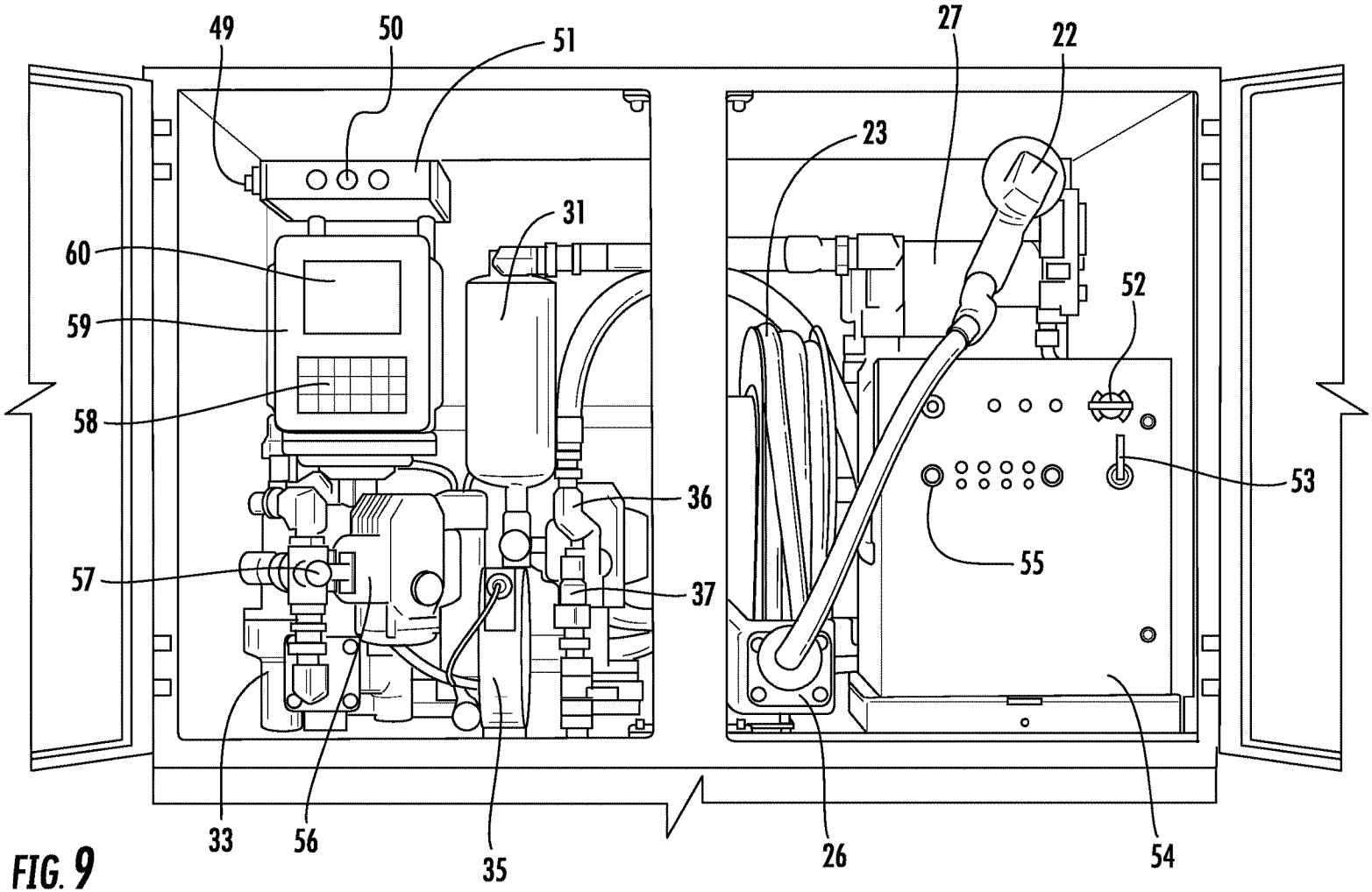
FIG. 9 is a rear view showing an embodiment of the present invention with electronic and semi-automated controls.

FIG. 9 is a rear view showing another embodiment of the present invention with electronic and semi-automated controls. In this preferred embodiment, there is a digital electronic register computer 59 with a keypad 58 and touch screen display 60, though non-touch screen displays are also known in the art, that has an Ethernet, Wi-Fi, cellular data, USB, Bluetooth, Serial, or other wired or wireless data connection port adapter or signal antenna 49, light-emitting diode (LED) push button interface 50, and electronic transaction reporting computer system with global positioning system capabilities, tank level sensor reading, pump controller ability, meter reading, differential pressure sensing, display output, printing, wired and wireless network and internet connection abilities to connect itself or other devices to itself or the internet, and security monitoring 51. In this preferred embodiment, there is an electronic control housing 54 that includes an emergency power disconnect switch 53, an on/off pump and purge controller switch 52, and a series of indicator lights 55 which can provide information on such functionality as valve position, pump status, and fueling controller state. Notice that in this preferred embodiment the location of the fuel hose 23 the fuel hose reel 26, are different than in earlier described embodiments. It is understood that there are many variations on exactly how the disclosed and described components could be assembled or located in the present invention. In the present preferred embodiment, the purge system valve actuator 56 is an electronically activated version instead of mechanically activated, which allows fuel to be pushed or drawn through the fuel hose lines and back to the tanks prior to transportation or at any time needed for operations and maintenance.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed:

1. A portable platform system for the transportation, storage, and dispensing of liquid fuel, the system comprising:

a plurality of non-manifolded fuel tanks, wherein each of the plurality of non-manifolded fuel tanks is independent of the others;

a fuel dispensing system consisting of a fuel pump, a fuel hose, and a nozzle, wherein the nozzle is configured to dispense the liquid fuel from more than one of the plurality of non-manifolded fuel tanks;

a portable platform consisting of a frame sufficient to support the weight of the entire system while the plurality of non-manifolded fuel tanks are full of the liquid fuel; and a valve system to allow the fuel pump to select which of the plurality of non-manifolded fuel tanks it is connected to in order to dispense the liquid fuel from at least one particular fuel tank within the plurality of non-manifolded fuel tanks.

2. The system of claim 1, further comprising of a fuel purge system.

3. The system of claim 2, wherein the fuel purge system comprises at least one valve which reverses the flow of the liquid fuel from within the fuel hose back into at least one of the plurality of non-manifolded fuel tanks as selected by an end user.

4. The system of claim 2, wherein the fuel purge system utilizes the fuel pump to invert the flow of the liquid fuel.

5. The system of claim 3, wherein the at least one valve of the fuel purge system is an electronically activated valve.

6. The system of claim 5, wherein the electronic activation is automatic once mechanically initiated by an end user.

7. The system of claim 5, wherein the electronic activation is automatic once dispensing the liquid fuel is completed.

8. The system of claim 5, wherein the electronic activation is automatically controlled by a computer system.

9. The system of claim 3, wherein the at least one valve of the fuel purge system is a mechanically activated valve.

10. The system of claim 1, wherein the valve system is a non-spill quick release valve system.

11. The system of claim 1, wherein each of the plurality of non-manifolded fuel tanks has an individual capacity no greater than one hundred and nineteen gallons.

12. The system of claim 1, further comprising of a custody-transfer flow meter.

13. The system of claim 1, wherein the frame has the ability to be transported by a fork-lift.

14. The system of claim 1, wherein the frame design is sufficient to allow the platform to fit in the bed or on the deck of a motor vehicle.

15. A portable platform system for the transportation, storage, and dispensing of liquid fuel, the system comprising:

a plurality of non-manifolded fuel tanks, wherein each of the plurality of non-manifolded fuel tanks is independent of the others;

a fuel dispensing system consisting of a fuel pump, a fuel hose, and a nozzle, wherein the nozzle is configured to dispense the liquid fuel from more than one of the plurality of non-manifolded fuel tanks;

a portable platform consisting of a frame sufficient to support the weight of the entire system while the plurality of non-manifolded fuel tanks are full of the liquid fuel;

a valve system to allow the fuel pump to select which of the plurality of non-manifolded fuel tanks it is connected to in order to dispense the liquid fuel from at least one particular fuel tank within the plurality of non-manifolded fuel tanks; and a custody-transfer flow meter.

16. The system of claim 15, further comprising of a fuel purge system.

17. The system of claim 16, wherein the fuel purge system comprises at least one valve which reverses the flow of the liquid fuel from within the fuel hose back into at least one of the plurality of fuel tanks as selected by an end user.

18. The system of claim 16, wherein the fuel purge system utilizes the fuel pump to invert the flow of the liquid fuel.

19. The system of claim 17, wherein the at least one valve of the fuel purge system is an electronically activated valve.

20. The system of claim 19, wherein the electronic activation is automatic once mechanically initiated by an end user.

21. The system of claim 19, wherein the electronic activation is automatic once dispensing the liquid fuel is completed.

22. The system of claim 19, wherein the electronic activation is automatically controlled by a computer system.

23. The system of claim 17, wherein the at least one valve of the fuel purge system is a mechanically activated valve.

24. The system of claim 15, wherein the frame has the ability to be transported by a fork-lift.

25. The system of claim 15, wherein the frame design is sufficient to allow the platform to fit in the bed or on the deck of a motor vehicle.

26. The system of claim 15, wherein the valve system is a non-spill quick release valve system.

27. The system of claim 15, wherein each of the plurality of non-manifolded fuel tanks has an individual capacity no greater than one hundred and nineteen gallons.

* * * * *